US010941649B2

(12) United States Patent
Egbe et al.

(10) Patent No.: US 10,941,649 B2
(45) Date of Patent: Mar. 9, 2021

(54) TOOL FOR TESTING WITHIN A WELLBORE

(71) Applicant: Saudi Arabian Oil Company, Dhahran (SA)

(72) Inventors: Peter Ido Egbe, Abqaiq (SA); Ossama R. Sehsah, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 338 days.

(21) Appl. No.: 15/956,832

(22) Filed: Apr. 19, 2018

(65) Prior Publication Data

US 2019/0323343 A1 Oct. 24, 2019

(51) Int. Cl.

| | |
|---|---|
| ***E21B 37/02*** | (2006.01) |
| ***E21B 47/117*** | (2012.01) |
| ***E21B 33/128*** | (2006.01) |
| ***E21B 47/13*** | (2012.01) |

(52) U.S. Cl.

CPC ..... *E21B 47/117* (2020.05); *E21B 33/1285* (2013.01); *E21B 37/02* (2013.01); *E21B 47/13* (2020.05)

(58) Field of Classification Search

CPC ..... E21B 33/12; E21B 33/1285; E21B 37/02; E21B 43/105; E21B 47/117; E21B 47/13

See application file for complete search history.

(56) References Cited

U.S. PATENT DOCUMENTS

| | | | | |
|---|---|---|---|---|
| 2,033,521 | A | | 3/1936 | Horn |
| 2,043,225 | A | | 6/1936 | Armentrout et al. |
| 2,138,057 | A | | 11/1938 | Armentrout et al. |
| 2,203,595 | A | | 6/1940 | Hall et al. |
| 2,226,804 | A | | 12/1940 | Carroll |
| 2,452,920 | A | | 11/1948 | Gilbert |
| 2,493,521 | A | | 1/1950 | Bermingham, Jr. |
| 2,627,317 | A | | 2/1953 | Baker |
| 4,411,314 | A | * | 10/1983 | Shearhart ..... E21B 23/06 166/124 |
| 5,291,947 | A | | 3/1994 | Stracke |
| 5,316,083 | A | | 5/1994 | Nahm et al. |
| 6,074,354 | A | | 6/2000 | Scholz et al. |

(Continued)

FOREIGN PATENT DOCUMENTS

| | | | |
|---|---|---|---|
| WO | WO-99/029999 | A1 | 6/1999 |
| WO | WO-01/83938 | A1 | 11/2001 |

(Continued)

OTHER PUBLICATIONS

Invitation to Pay Additional Fees Form PCT/ISA/206 for PCT/IB2018/056526, 12 pages (dated Feb. 26, 2019).

(Continued)

*Primary Examiner* — Christopher J Sebesta

(74) *Attorney, Agent, or Firm* — Choate, Hall & Stewart LLP; Charles E. Lyon; Peter A. Flynn

(57) ABSTRACT

An example tool for testing a wellbore includes a body having a longitudinal dimension configured for insertion into a casing of the wellbore, and a packer disposed along the body. The packer is controllable to expand against an inner diameter of the casing to enable testing the wellbore. The example tool also includes a scraper assembly disposed along the body for arrangement downhole of the packer when the body is inserted into the casing.

22 Claims, 5 Drawing Sheets

(56) References Cited

U.S. PATENT DOCUMENTS 6,371,207 B1* 4/2002 Reynolds ..... E21B 21/00 166/312
6,695,051 B2* 2/2004 Smith ..... E21B 33/1204 166/134
7,225,867 B2 6/2007 Mackenzie et al.
8,122,966 B2 2/2012 Kelley
8,201,635 B2 6/2012 Lohbeck
8,800,650 B2* 8/2014 Spray ..... E21B 43/103 166/207
8,978,765 B2 3/2015 Braekke et al.
8,997,857 B2 4/2015 Wubben et al.
9,022,130 B2 5/2015 Telfer
9,624,723 B2 4/2017 Fraser
9,683,440 B2 6/2017 Brown-Kerr et al.
9,708,904 B2 7/2017 McGarian et al.
9,732,566 B2 8/2017 Mejia et al.
2003/0168214 A1 9/2003 Sollesnes
2004/0168806 A1* 9/2004 Booth ..... E21B 37/02 166/311
2007/0131413 A1* 6/2007 Millet ..... F16L 55/136 166/115
2008/0223580 A1* 9/2008 Anderson ..... E21B 21/00 166/312
2009/0090502 A1 4/2009 Lumbye et al.
2010/0126717 A1* 5/2010 Kuchuk ..... E21B 49/008 166/250.03
2010/0319427 A1 12/2010 Lohbeck
2010/0326671 A1* 12/2010 Buytaert ..... E21B 19/16 166/378
2012/0132438 A1* 5/2012 Telfer ..... E21B 23/04 166/373
2015/0027724 A1* 1/2015 Symms ..... E21B 33/1243 166/373
2015/0068743 A1* 3/2015 Broussard ..... E21B 33/126 166/278
2015/0122489 A1 5/2015 Wood et al.
2015/0315903 A1 11/2015 Abbassian et al.
2016/0108716 A1 4/2016 Brown-Kerr et al.
2016/0230496 A1* 8/2016 Lastra ..... E21B 33/1208
2016/0281457 A1 9/2016 Foubister et al.
2017/0114608 A1* 4/2017 Dighe ..... E21B 33/146
2017/0252547 A1 9/2017 Burton et al.
2018/0216429 A1* 8/2018 Dockweiler ..... E21B 23/01

FOREIGN PATENT DOCUMENTS

WO WO-2010/119010 A2 10/2010
WO WO-2011/117606 A2 9/2011
WO WO-2016/168259 A1 10/2016
WO WO-2017/100939 A1 6/2017
WO WO-2019/202372 A1 10/2019

OTHER PUBLICATIONS

International Search Report for PCT/IB2018/056526, 7 pages (dated May 7, 2019).
Written Opinion for PCT/IB2018/056526, 13 pages (dated May 7, 2019).
Written Opinion of the International Preliminary Examining Authority for PCT/IB2018/056526, 10 pages (dated Apr. 20, 2020).

* cited by examiner

TOOL FOR TESTING WITHIN A WELLBORE

TECHNICAL FIELD

This specification describes example implementations of a tool for performing testing operations, such as integrity testing, within a wellbore.

BACKGROUND

During construction of an oil or gas well, a drill string having a drill bit bores through earth, rock, and other materials to form a wellbore. The drilling process includes, among other things, pumping drilling fluid down into the wellbore, and receiving return fluid and materials from the wellbore at the surface. In order for the well to become a production well, the well must be completed. Part of the well construction process includes incorporating casing and production tubing into the wellbore. Casing or liner supports the sides of the wellbore, and protects components of the well from outside contaminants. The casing may be cemented in place, and the cement may be allowed to harden as part of the well construction process.

The casing may be a casing or a liner string. A casing or liner string includes multiple segments. In some examples, each casing segment is supported by an immediately-preceding uphole casing segment. The downhole casing segment is said to hang from the uphole casing segment. In the case of a liner string, the downhole casing segment is hung off the previous casing string using a liner hanger system at a pre-determined depth. The status of the liner hanger system as a confirmed and tested barrier is a factor in the long term integrity of the well. A connector, such as a joint, connects two casing segments together and provides a seal between the casings. The joint is a potential point of failure of the casing string. For example, the joint may be susceptible to damage or leakage. Testing, such as integrity testing, may be performed on the casing string to confirm that it is in good condition.

SUMMARY

An example tool for testing a wellbore includes a body having a longitudinal dimension configured for insertion into a casing of the wellbore, and a packer disposed along the body. The packer is controllable to expand against an inner diameter of the casing to enable testing the wellbore. The example tool also includes a scraper assembly disposed along the body for arrangement downhole of the packer when the body is inserted into the casing. The example tool may include one or more of the following features, either alone or in combination.

The packer may include a radio frequency identification (RFID) device configured to identify a radio frequency signal and, in response to the radio frequency signal, to cause the packer to expand against the inner diameter of the casing. The packer may include at least one switch that is configured for hydraulic operation to cause the packer to expand against the inner diameter of the casing. At least part of the packer may be configured to rotate to cause the packer to expand against the inner diameter of the casing. The packer may include multiple, redundant activation mechanisms. Each of the activation mechanisms may be configured to cause the packer to expand against the inner diameter of the casing.

The packer may include a first packer. The tool may include multiple packers including the first packer. Each of the multiple packers may be separated by a part of the body. Each of the packers may be configured expand against the inner diameter of the casing independently of the others of the packers. Each of the packers may include an RFID device configured to identify a radio frequency signal and, in response to the radio frequency signal, to cause the packer to expand against the inner diameter of the casing. Each of the packers may include at least one switch that is configured for hydraulic operation to cause the packer to expand against the inner diameter of the casing. At least part of each of the packers may be configured to rotate to cause the packer to expand against the inner diameter of the casing.

The packer may be configured to provide bi-directional sealing of an uphole part of the casing from a downhole part of the casing. The tool may include a hydraulic anchor slip mechanism configured to provide resistance to uphole movement of the packer. The packer may be controllable to enable circulation within the wellbore uphole of the packer. The casing may include a casing string comprised of casing segments. The casing segments may be connected by a joint. The tool may be controllable to isolate the joint uphole of the packer from a portion of the wellbore that is downhole of the packer.

An example system includes a casing string having a first casing segment and a second casing segment. The first casing segment and the second casing segment are separated by a joint. A tool is configured to fit within the casing string. The tool includes a packer to isolate, for integrity testing, a first part of the casing string containing the joint from a second part of the casing string not containing the joint. The packer includes an activation mechanism to cause the packer expand to isolate the first part from the second part. The activation mechanism is one of multiple redundant mechanisms. The example system may include one or more of the following features, either alone or in combination.

The activation mechanism may include an RFID device configured to identify a radio frequency signal and, in response to the radio frequency signal, to cause the packer to expand against an inner diameter of the casing string. The activation mechanism may include at least one switch that is configured for hydraulic operation to cause the packer to expand against an inner diameter of the casing string. The activation mechanism may include a rotation mechanism that is configured to rotate to cause the packer to expand against an inner diameter of the casing string.

The multiple redundant mechanisms may include an RFID device configured to identify a radio frequency signal and, in response to the radio frequency signal, to cause the packer to expand against an inner diameter of the casing string; at least one switch that is configured for hydraulic operation to operate the packer to cause the packer to expand against the inner diameter of the casing string; and a rotation mechanism that is configured to rotate to cause the packer to expand against the inner diameter of the casing string.

The integrity testing may be, or include, negative integrity testing. The integrity testing may be, or include, positive integrity testing.

Any two or more of the features described in this specification, including in this summary section, can be combined to form implementations not specifically described in this specification.

The tools, systems, and processes described in this specification, or portions of the tools, systems, and processes, can be controlled using a computer program product that includes instructions that are stored on one or more non-transitory machine-readable storage media, and that are executable on one or more processing devices to control (for example, to coordinate) the operations described in this specification. The tools, systems, and processes described in this specification, or portions of the tools, systems, and processes can include one or more processing devices and memory to store executable instructions to implement various operations.

The details of one or more implementations are set forth in the accompanying drawings and the description below. Other features and advantages will be apparent from the description and drawings, and from the claims.

DESCRIPTION OF THE DRAWINGS

Like reference numerals in different figures indicate like elements.

DETAILED DESCRIPTION

Figure 1:
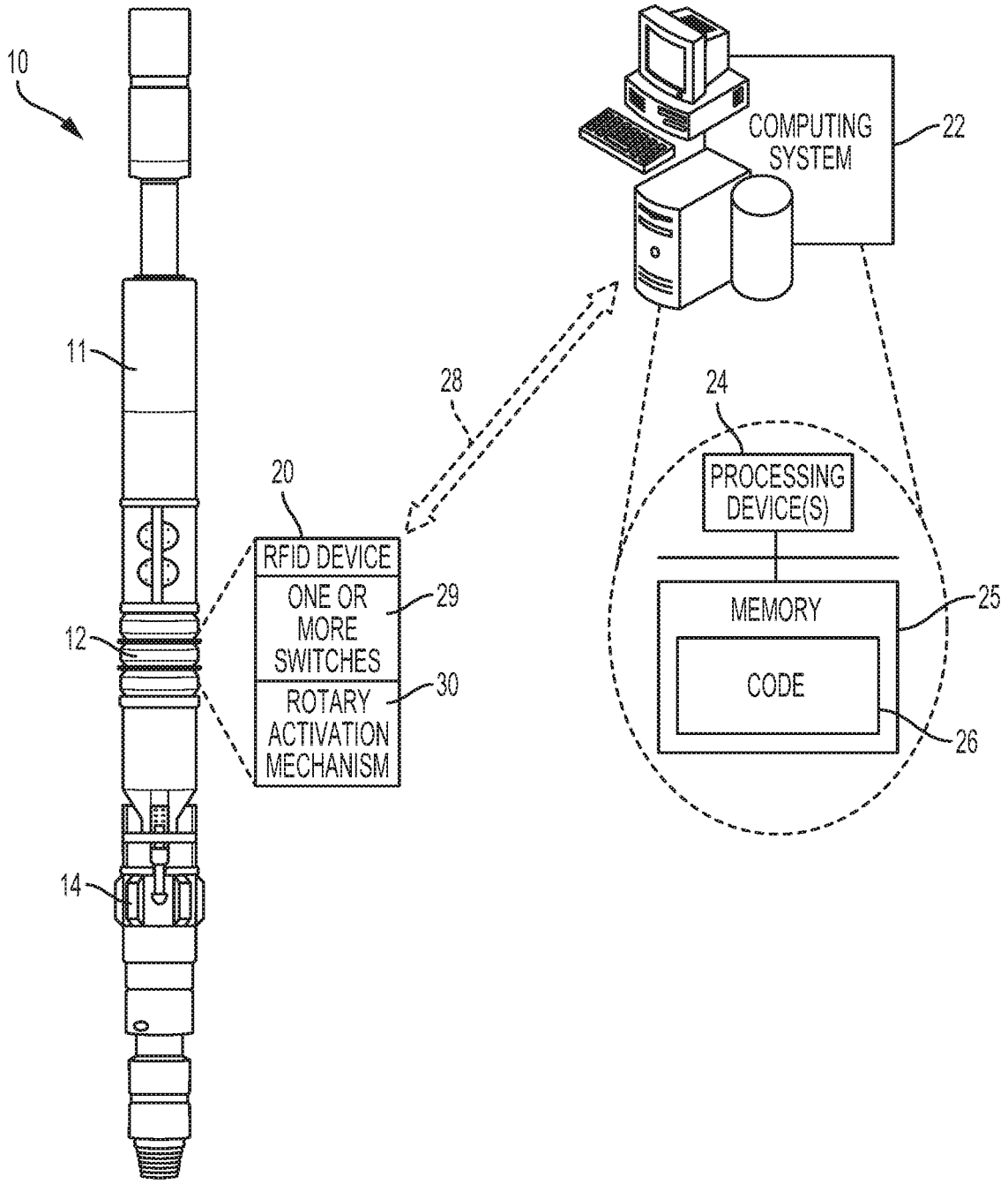
FIG. 1 is a side view of an example tool for performing testing operations, together with an example computing system in communication with the tool.

Described in this specification are examples of a tool for performing testing on a wellbore. For example, the tool may be used in performing integrity testing on a casing or liner inside the wellbore. In some examples, the casing may be, or include, a casing string containing multiple casing segments. Adjacent casing segments may be connected by a joint or other appropriate connector. The tool may be used to perform integrity testing on an area of the joint, for example. However, the tool is not limited to testing areas of the casing containing joints or connections. Integrity testing may include a positive pressure test, a negative pressure test, or both a positive and a negative pressure test.

In an example negative pressure test, a hydrostatic pressure in the wellbore is reduced so that a net differential pressure direction is from a formation into the wellbore. In an example, the pressure inside the wellbore is reduced over time. The test is performed to confirm that the casing and cement separating the wellbore from a hydrocarbon-bearing formation can withstand the pressure differential without leaking. In an example positive pressure test, the test is done at a predetermined mud weight equivalent to a calculated pressure of not more than 80% of the casing or liner burst pressure in accordance with American Petroleum Institute recommendations. The pressure at which this occurs constitutes the maximum allowable casing pressure or mud weight that may be allowed in the casing or liner annulus while producing the well.

Both the positive pressure test and the negative pressure test can affect the integrity of the casing. A joint connecting two casing segments may be particularly susceptible to failure during such testing. The example tool may be used to isolate parts of the casing string, such as a part containing a joint, and to perform pressure testing on that part to determine whether the casing string meets expected operational standards. Individual, potentially problematic, parts of the casing string may be isolated and tested. By performing testing in this manner, it may be possible to test parts that are prone to failure, and to identify failures at selected points along the casing string. For example, the tool may be used to isolate, for integrity testing, a first part of the casing string containing a joint connecting two casing segments from a second part of the casing string not containing the joint. In an example, the tool may be controllable to isolate the joint uphole or downhole of a packer from a portion of the wellbore that is downhole of the packer. This isolation may enable pressure testing to be performed on a selected part of the casing string, such as the part containing the joint.

In some implementations, the example tool includes a body having a longitudinal dimension configured for insertion into a casing of the wellbore. A packer, which is disposed along the body, is controllable to expand against an inner diameter of the casing to enable testing the wellbore. In this regard, in some casing strings, different casing segments may have different diameters. For example, each successive downhole casing segment may have a smaller diameter than the immediately preceding casing segment in the casing string. Accordingly, in some implementations, the tool is configured to fit within the smallest-diameter casing segment that is to be subjected to testing. For example, the tool, when the packer is not expanded, may have a maximum outer diameter that is less than the internal diameter of the smallest-diameter casing segment that is to be subjected to testing. Likewise, in some implementations, the packer is configured to expand to the largest internal-diameter casing segment that is to be subjected to testing.

By controlling the packer to expand against an inner diameter of the casing, the tool is able to isolate a part of the wellbore above the packer from a part of the wellbore below the packer. The isolation may prevent transfer of liquids and solids between two isolated zones—one above the packer and one below the packer. The isolation may prevent transfer of gases between the two zones, thus enabling one zone to be at a different pressure than the other zone. In some cases, the isolation may prevent transfer of liquids, solids, and gases between the two zones. In some implementations, integrity testing—such as positive and negative pressure tests—may be performed in one isolated zone independent of conditions in the other isolated zone.

In some implementations, the tool may include a scraper assembly disposed along the body for arrangement downhole of the packer when the body is inserted into the casing. The scraper assembly may be configured, controllable, or configured and controllable to scrape the inside of the casing. For example, cement, mud, debris, and other content may be present in the casing string prior to insertion of the tool. The scraper may be used to remove or to push cement, mud, debris, or other content from the casing to enable insertion of the tool for testing. In some implementations, the tool need not, and does not, include a scraper assembly.

FIG. 1 shows an example implementation of the tool described previously. In this example, tool 10 includes a body 11. Body 11 has an elongate shape that is at least partly cylindrical, in this example. Body 11 is sized to fit within a casing to be subjected to testing. A packer 12 is disposed along body 11. Packer 12 is controllable to expand diametrically to reach, and to press against, an inner diameter of the casing to form a seal against the casing within the wellbore. This seal isolates the part of the wellbore above the packer from the part of the wellbore below the packer. The example of FIG. 1 includes a single packer. In some implementations, such as that shown in FIG. 4, the tool may include multiple packers. A scraper assembly 14 is disposed along body for arrangement downhole of packer 12 when the tool is inserted into the casing.

As described previously, body 11 is configured to fit within the smallest inner-diameter casing segment that is to be subjected to testing. For example, the tool, when the packer is not expanded, may have a maximum diameter that is less than the inner diameter of the smallest-diameter casing segment that is to be subjected to testing. In some implementations, the packer is configured to enable diametric expansion to isolate the smallest inner-diameter casing segment that is to be subjected to testing. In some implementations, the packer is configured to enable diametric expansion to isolate the largest inner-diameter casing segment that is to be subjected to testing. In some implementations, the packer is configured to enable diametric expansion to enable isolation of any segment between the smallest inner-diameter casing segment and the largest inner-diameter casing segment that is to be subjected to testing.

Figure 2:
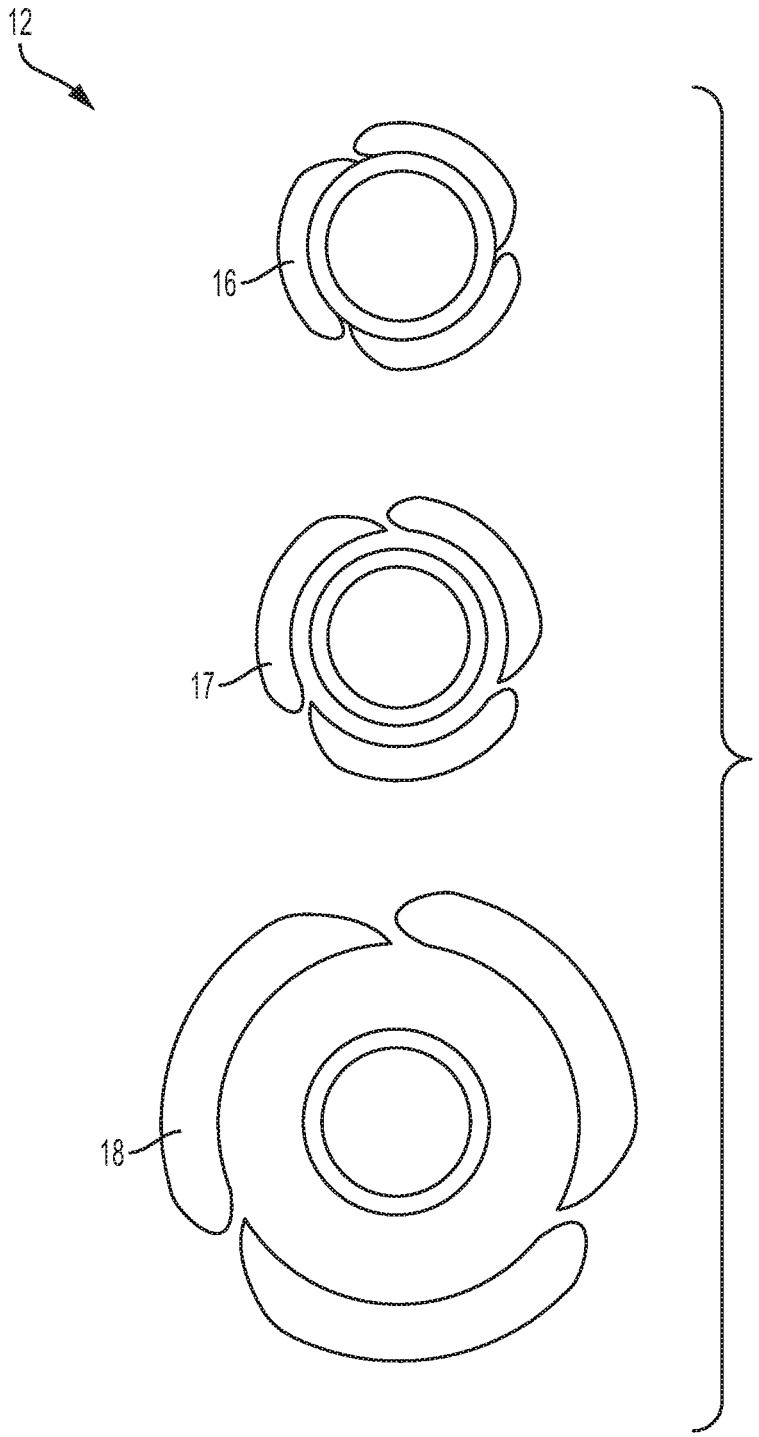
FIG. 2 is a top view of an example packer showing different amounts of diametric expansion of the packer.

FIG. 2 shows top views of example packer 12 in a closed positon 16, in a partially-open position 17, and in a fully-open position 18 As shown in FIG. 2, diametric expansion from the closed position to the fully open position allows the packer to provide full or partial isolation for casing segments having different-sized inner diameters. For example, a smaller inner-diameter casing may be isolated by the packer in a configuration closer to the closed position, whereas a larger inner-diameter casing may be isolated by the packer in a configuration closer to the fully open position.

In some implementations, packer 12 includes multiple, redundant activation mechanisms. The activation mechanisms may be redundant in the sense that if one mechanism fails to control the packer, another mechanism may be used in its place to control the packer. In some implementations, one mechanism may be used to expand or to activate a packer and a different mechanism may be used to retract or to deactivate the packer. In some implementations, different mechanisms may be used for controlling different degrees of expansion toward the casing or retraction from the casing. For example, one activation mechanism may be used to expand a packer from a fully closed to a partially open position, and another, different mechanism may be used to expand the packer from the partially open position to a fully open position.

In some implementations, each of the activation mechanisms is configured to control operation of the packer when the tool is downhole. For example, each of the activation mechanisms may be configured to cause the packer to expand against an inner diameter of the casing to isolate—for example, to seal—a first zone of the wellbore above the packer from a second zone of the wellbore below the packer. The isolation between zones may be bi-directional in the sense that liquid, gas, or solids from the first zone may be prevented from entering the second zone, and liquid, gas, or solids from the second zone may be prevented from entering the first zone. Each of the activation mechanisms may also be configured to cause the packer to retract or to deactivate, thereby allowing liquid, gas, or solids to pass between zones.

Examples of activation mechanisms that may be used with the packer include, but are not limited to, the following activation mechanisms, which are configured to activate a downhole packer on-demand. In some implementations, the packer includes all of the following activation mechanisms. In some implementations, the packer includes only one of the activation mechanisms. Each of the activation mechanisms may be redundant to one or more others of the activation mechanisms. Although three example activation mechanisms are described, in some implementations, a packer may include more or fewer—for example, one two, or four—activation mechanisms.

An example activation mechanism includes a radio frequency (RF) identification (RFID) device 20. In this example, RFID device 20 is configured to identify a radio frequency signal and, in response to the identified radio frequency signal, to cause the packer to expand against the inner diameter of the casing. If the packer is already expanded, an appropriate RFID signature may be sent to retract the packer, in whole or in part. In some implementations, an RF signal is transmitted downhole from a computing device, such as computing system 22.

Examples of devices that may be part of computing system 22 are described subsequently. Computing system 22 includes one or more processing devices 24 of the type described in this specification. Processing devices 24 also includes memory 25. Memory 25 stores code 26 this is executable to control packer 12. For example, code 26 may be part of a computer program for controlling integrity testing of a wellbore. Code 26 may be executable to generate one or more RF signals, and to cause those RF signals to be transmitted downhole to the RFID device associated with packer 12. Transmission, which may be implemented by a transmission device associated with the computing system, is represented by arrow 28 in FIG. 1.

In this example, the RFID device associated with, and for controlling, the packer includes an RF receiver configured to receive, and to recognize, one or more of the RF signals. Upon receipt of an appropriate RF signal or signals, packer 12 may be controlled to expand diametrically to reach the inner diameter of the casing, and to isolate—for example, to seal—one part of the casing from another part of the casing. The RFID device may be incorporated into a test collar on the body of the tool.

An example activation mechanism includes one or more switches 29 that are responsive to hydraulic pressure to operate the packer. In response to activation of one or more of the switches, the packer is configured to expand against the inner diameter of the casing. If the packer is already expanded, the switches may be used to retract the packer, in whole or in part. In some examples, the switches are, or include, one or more preset pressure activation switches. Hydraulic fluid lines may be connected between a wellhead on the surface and the preset pressure switches. In response to application of hydraulic pressure, the one or more preset pressure activation switches control packer 12 to expand diametrically to reach the inner diameter of the casing, and to isolate one part of the casing from another part of the casing.

An example rotary activation mechanism 30 may be incorporated into the packer. At least part of the packer may be configured to rotate to cause the packer to expand against the inner diameter of the casing. Rotation may be controlled from the wellhead or from any other appropriate location. In some implementations, a weight is applied to the packer, and a part of the packer is rotated in a first direction. Rotation in the first direction causes diametric expansion of the packer to isolate one part of the casing from another part of the casing. In some implementations, rotation in a second direction that is opposite to the first direction causes diametric retraction that will eliminate, or reduce, the isolation of the one part of the casing string from the other part of the casing string. In an example, to activate the isolation packer system using rotation, a drill string is moved into the wellbore. The drill string is turned in the wellbore to activate a rotary mechanism while holding a torque on the rotary mechanism and applying weight to allow mechanical slips of the packer to expand diametrically. To retract or to deactivate the packer, pressure across the packer is equalized. Then, the drill string is pulled-up to retract the mechanical slips and, thus, to release the test tool.

In some implementations, the mechanical slips may be configured to provide bi-directional sealing, examples of which are described previously. In some examples, each mechanical slip is or includes, a wedge-shaped device having wickers—or teeth—on its face, which penetrate and grip the casing wall when the packer is expanded to reach the inner diameter of the casing. A hydraulic anchor slip mechanism may be incorporated into the packer to provide resistance to uphole movement of the packer in cases where there is a higher pressure below the packer than above the packer. The packer may also include one or more drag blocks and multiple J-slot sleeves to support several cycles of activation and de-activation.

As explained previously, in some cases, the tool may include a scraper assembly 14, which may be spring-loaded and arranged to be located downhole of the packer when the tool is within the wellbore. Scraper assembly 14 may be, or include, a composite block to scrape and to clean to at least the packer setting depth. The outer diameter scraper assembly may be configured to fit the inner diameter of the casing to be scraped or cleaned prior to setting of the packer and creating isolation. Some implementations of the tool need not, and do not, include a scraper assembly.

In some implementations, the packer is configured to be activated and to be de-activated on demand for multiple cycles. This may be done in order to achieve desired casing integrity testing objectives either in a stand-alone mode or as part of a wellbore cleanout operation. In some implementations, the isolation produced by the tool enables fluid circulation uphole of the packer. This feature may allow fluid uphole of the packer to be displaced with a fluid having a lower density, for example, in cases where a negative pressure test is performed.

Figure 3:
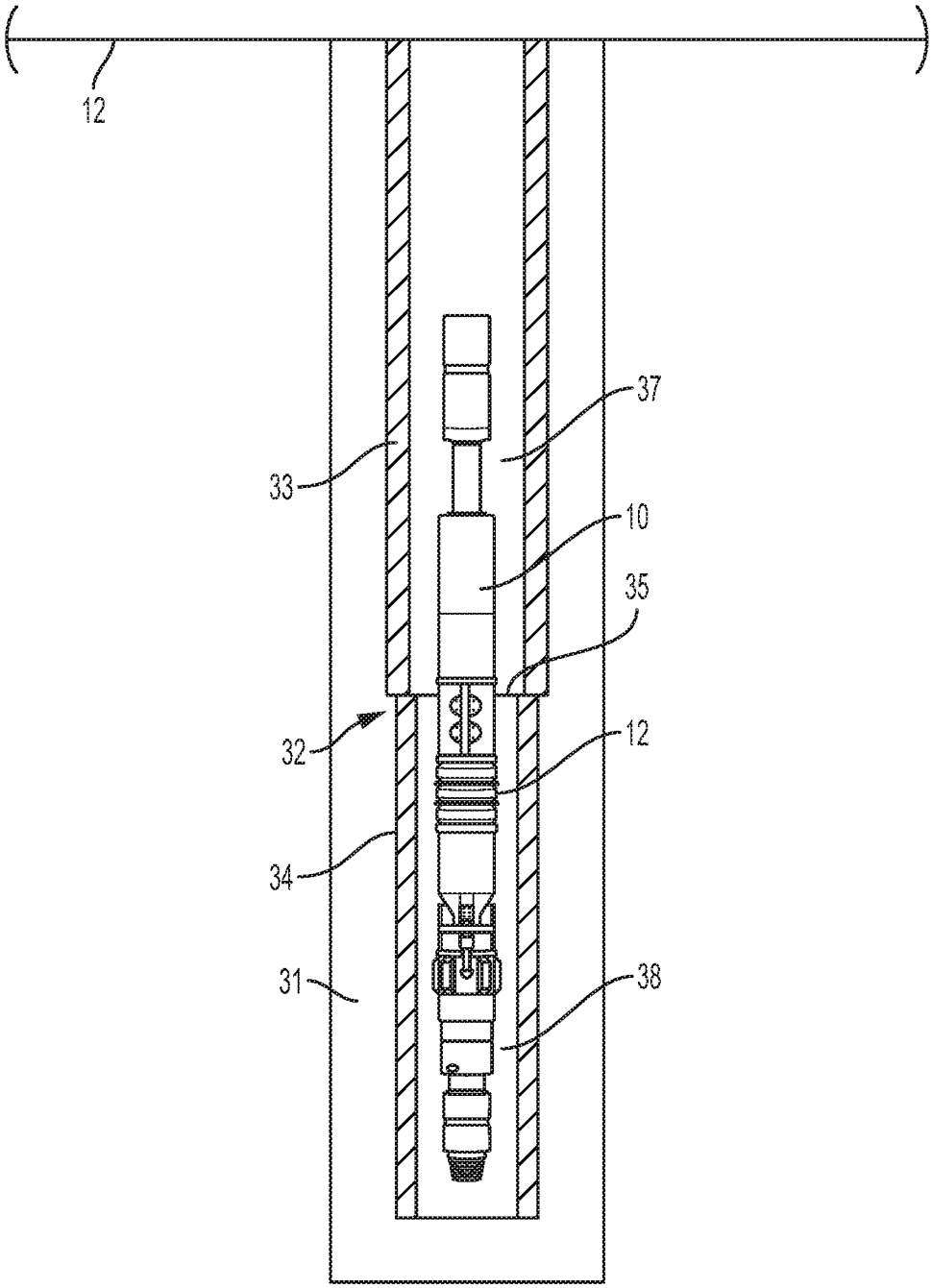
FIG. 3 is a cut-away, side view of an example wellbore having, downhole, an example tool for performing testing operations.

FIG. 3 shows example tool 10 disposed within a wellbore 31 containing a casing string 32. In this example, casing string 32 contains two casing segments 33 and 34. Casing segments 33 and 34 are connected by joint 35, which allows casing segment 34 to hang from casing segment 33. The joint is located at the top of a casing segment, which may be referred to as the top of a liner. Generally, a liner includes the part of the casing string that does not extend to the top of the wellbore. In this example, packer 12 is arranged below joint 35; however, in other examples packer 12 may be arranged above joint 35. Packer 12 may be expanded to isolate upper zone 37 of wellbore 31 from lower zone 38 of wellbore 31. As a result of this isolation, integrity tests may be performed in zone 37, in zone 38, or in both zones 37 and 38. The same type of integrity tests may be performed in both zones contemporaneously, or different types of integrity tests may be performed in different zones contemporaneously. By isolating the zones using tool 10, it may be possible to identify, more quickly, where a failure occurred on casing string 32 than if the zones were not isolated.

Figure 4:
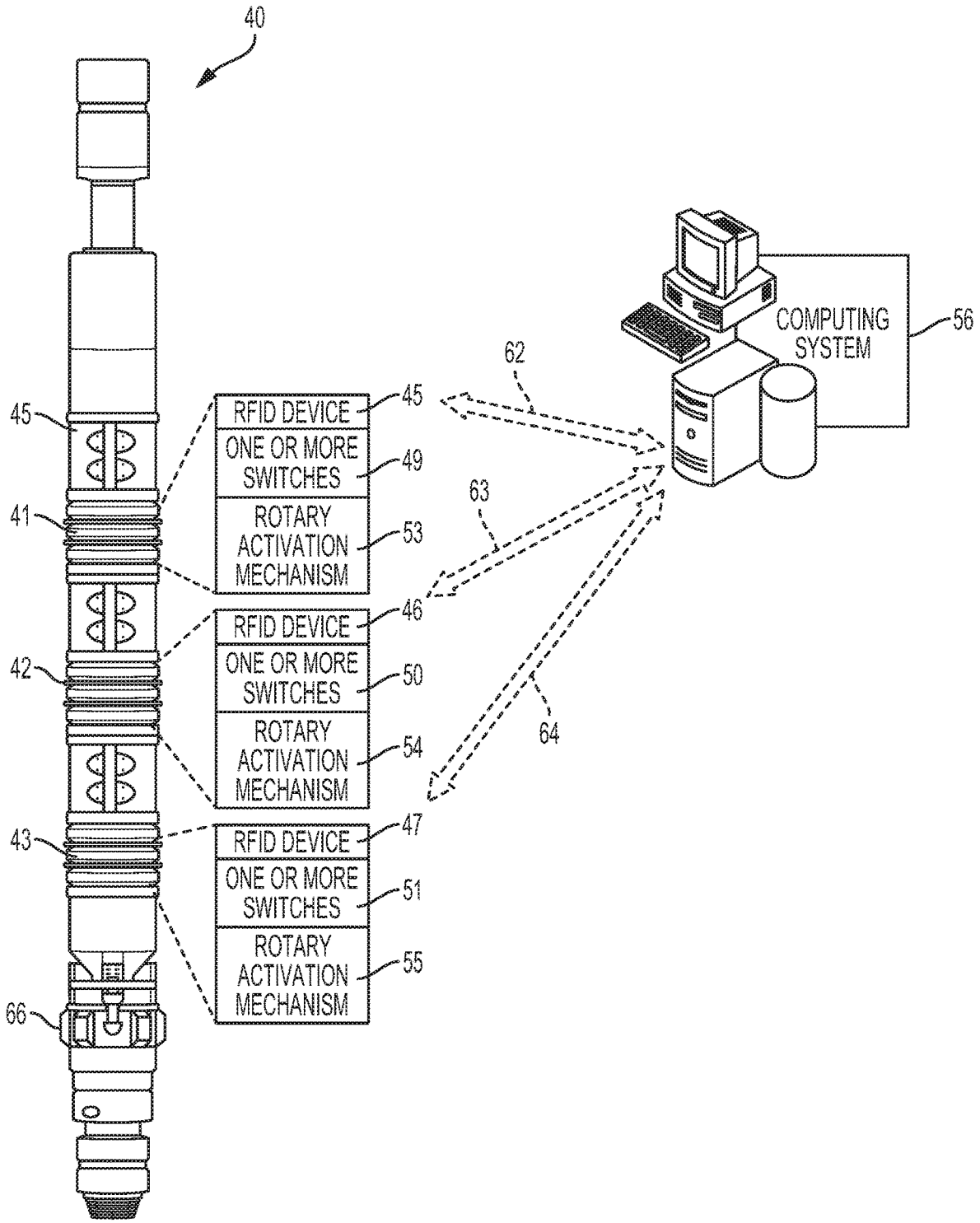
FIG. 4 is a side view of an example tool for performing testing operations, together with an example computing system in communication with the tool.

FIG. 4 shows an example implementation of the tool described previously. In this example, tool 40 includes multiple packers 41, 42, and 43. In this example, tool 40 includes three packers; however, the tool is not limited to use with three packers. Any appropriate number of packers may be incorporated into the tool. Each of packers 41, 42, and 43 is separated by a part of body 45, as show in the figure. Furthermore, each of packers 41, 42, and 43 is configured to expand against the inner diameter of the casing independently of the other packers. Each of packers 41, 42, and 43 is also configured to retract independently of the other packers. This is because, in some implementations, each packer contains its own, and independently-operable, activation mechanism or mechanisms. In an example, packer 41 may be activated, while packers 42 and 43 may remain deactivated. In an example, packers 41 and 42 may be activated, while packer 43 may remain deactivated. In an example, packer 41 may be expanded diametrically to its fully open position; packer 42 may be expanded diametrically to a partially open position; and packer 43 may remain closed. In an example, packer 41 may be expanded diametrically to its fully open position; packer 42 may be expanded diametrically to its fully open position; and packer 43 may be expanded diametrically to its partially open position. Generally, the multiple packers may be controlled independently in any appropriate manner. Such independent control may enable the different packers to isolate different parts of a casing string having different diameters. Examples of such isolation are provided subsequently.

Each of packers 41, 42, and 43 may include any one or more—for example, all—of the redundant activation mechanisms described for use with packer 12 of FIG. 1. Each of the activation mechanisms is configured to control operation of the packer when the tool is downhole to cause diametric expansion or retraction to isolate portions of the wellbore. Each activation mechanism may control its corresponding packer independently of other activation mechanisms included on that same packer.

An example activation mechanism includes an RFID device 45, 46, 47, each configured to identify a radio frequency signal and, in response to the radio frequency signal, to cause the packer to expand against the inner diameter of the casing. If the packer is already expanded, the RFID signal may cause the packer to retract. In the case of multiple packers, such as packers 41, 42, 43, each RFID device may have its own, unique radio frequency signature. As a result, each packer may be individually and independently controllable through transmission of its unique RFID signal. Other features of the RFID device may be the same as described for packer 12.

An example activation mechanism includes one or more switches 49, 50, 51 that are responsive to hydraulic pressure to operate the packer. In response to activation of one or more of the switches, the packer is configured to expand against the inner diameter of the casing. In the case of multiple packers, such as packers 41, 42, 43, each packer may include its own, independently-controllable switch or switches. Separate hydraulic fluid lines may be connected between a wellhead on the surface and each switch or set of switches per packer to control their operation. As a result, each packer may be individually and independently controllable through switch operation. Other features of the switches may be the same as described for packer 12.

An example activation mechanism that may be incorporated into each of packers 41, 42, 43 is a rotary mechanism 53, 54, 55. At least part of each packer 41, 42, 43 may be configured to rotate to cause the packer to expand against the inner diameter of the casing. Rotation may be controlled from the wellhead or any other appropriate location using the drill string or any other appropriate mechanism or mechanisms. The rotation of each packer may be controlled independently of the rotation of any other packers. Consequently, each packer may be individually and independently controllable to expand or to retract, as appropriate. Other features of packer rotation control may be the same as described for packer 12.

Although the packers are described as being individually and independently controllable, in some implementations, the operation of two or more of the packers may be coordinated. For examples, two or more of the packers 41, 42, 43 may, in some cases, be operated in synchronism as appropriate.

As explained for packer 12, each activation mechanism may be redundant in the sense that if one mechanism fails to control a packer, another mechanism may be used to control the packer. In some implementations, one mechanism may be used to expand or to activate a packer and a different mechanism may be used to retract or to deactivate that same packer. In some implementations, different mechanisms may be used for controlling different degrees of expansion of the packer toward the casing or retraction of the packer from the casing. For example, one activation mechanism may be used to expand a packer from a fully closed to a partially open position, and another, different mechanism may be used to expand that same packer from the partially open position to a fully open position.

In the example of FIG. 4, each of the activation mechanisms may be configured to cause one or more of packers 41, 42, 43 to expand against an inner diameter of the casing to isolate—for example, to seal—different zones of the wellbore from each other. The isolation between zones may be bi-directional in the sense that liquid, gas, or solids from any one zone may be prevented from entering any other zone. As appropriate, each of packers 41, 42, 43 is configured to communicate with computing system 56. Computing system 56 may have an architecture that is the same as, or similar to, the architecture of computing system 22. Computing system 56 may store code that is executable to generate one or more RF signals, and to cause those RF signals to be transmitted downhole to the RFID device associated with each packer. Transmission, which may be implemented by a transmission device associated with the computing system, is represented by arrows 62, 63, 64 in FIG. 4.

In some implementations, each packer is configured to be activated and to be de-activated on demand for multiple cycles. This may be done in order to achieve desired casing or liner integrity testing objectives either in a stand-alone mode or as part of a wellbore cleanout operation. In some implementations, the isolation produced by the tool enables fluid circulation uphole of one or more of the packers. This feature allows fluid uphole of the one or more packers to be displaced with a fluid having a lower density, for example, in cases where a negative pressure test is performed.

Tool 40 may include a scraper assembly 66 of the type described for tool 10. Scraper assembly 66 may be spring-loaded and arranged to be located downhole of all packers when the tool is within the wellbore. Scraper assembly 66 may be, or include, a composite block to scrape and to clean to appropriate packer setting depths. The outer diameter of the scraper assembly may be configured to fit the inner diameter of the casing or liner to be scraped or cleaned prior to setting the packers and creating isolation. Some implementations of the tool need not, and do not, include a scraper assembly.

Figure 5:
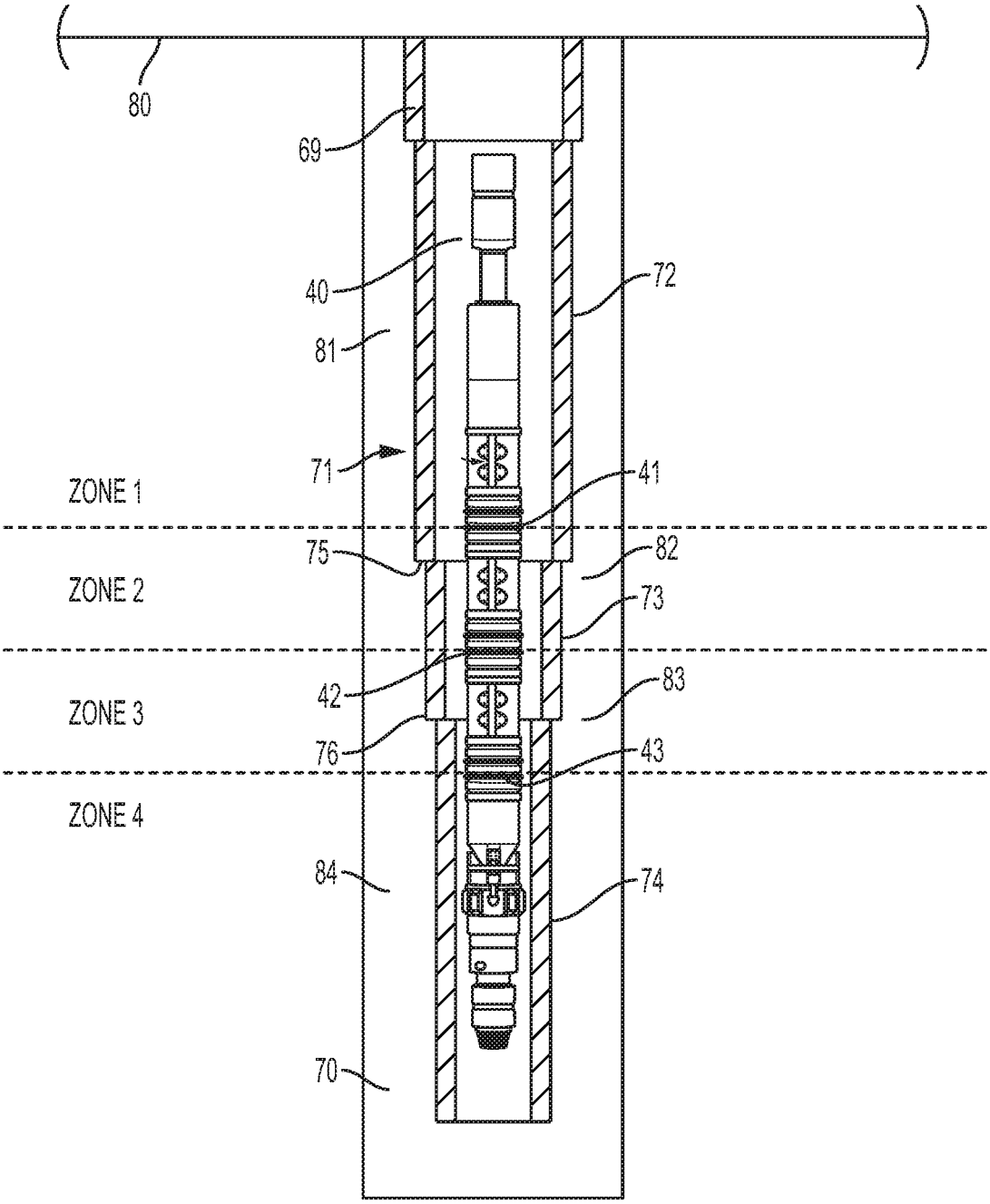
FIG. 5 is a cut-away, side view of an example wellbore having, downhole, an example tool for performing testing operations.

FIG. 5 shows example tool 40 disposed within a wellbore 70 containing a casing string 71. In this example, casing string 71 contains four casing segments 69, 72, 73, and 74. Casing segment 69 connects to surface 80. Casing segments 72 and 73 are part of a liner and are connected by joint 75. Casing segments 73 and 74 are part of a liner and are connected by joint 76. In this example, packer 41 is arranged above joint 75; packer 42 is arranged between joints 75 and 76; and packer 43 is arranged below joint 76. However, tool 40 may be arranged in the wellbore in a different location than that shown in FIG. 5, resulting in different isolation points. In this example, packer 41 may be expanded to isolate zone 1 81 within the wellbore from zone 2 82 within the wellbore; packer 42 may be expanded to isolate zone 2 82 from zone 3 83 within the wellbore; and packer 43 may be expanded to isolate zone 3 83 within the wellbore from zone 4 84. In this example, each of zones 81, 82, 83, and 84 may be isolated, preventing solids, liquid, or gas from passing between zones. In this example also, because the casing segments have different diameters, the diametric expansion of each of packers 41, 42, and 43 may each be different. For example, packer 43 will expand least, since the casing segment in which it is disposed has the smallest inner diameter. Packer 41 will expand most, since the casing segment in which it is disposed has the largest inner diameter. Packer 42 expands less than packer 41 but more than packer 43, since packer 42 is within an intermediate-diameter casing segment.

As a result of isolation of zones of zones 81, 82, 83, and 84, integrity tests may be performed for any individual one of these zone, for any appropriate combination of these zones, or for all of these zones. As described previously, by isolating the zones using tool 40, it may be possible to identify, more quickly, where a failure occurred on a casing string than if the zones were not isolated. In this particular example, the isolation may enable an engineer to determine that a point of failure is joint 75 and not joint 76.

In some implementations, two or more of the tools described in this specification may be run in-hole in series depending on the casing or liner integrity test objectives to be achieved. For example, two or more of tool 10 may be run in-hole in series; two more of tool 40 may be run in-hole in series; or one or more of tool 10 may be run in-hole in series with one or more of tools 40 in any appropriate sequence.

Advantages of the example tools described in this specification may include one or more of the following. Integrity testing of a top of a casing or liner segment may be performed without requiring a separate operation or tool to clean out cement from the casing or liner. The tool may facilitate testing and investigation of liner or casing integrity in critical wells where casing leaks have been observed or are suspected, such as gas wells or high-pressure, high-temperature wells. If used for testing casing integrity, one or more of the tools may be lowered downhole and may be used to test or to investigate the integrity of two or more sections of a casing or liner string in order to identify leak points. If multiple tools are used, different pressure activation switches may be pre-set to allow the activation and deactivation of each tool or of each packer independently.

The tools may reduce the weight requirements of heavy weight drill pipes or collars needed for liner top testing in cases where an activation mechanism applies weight to allow mechanical slips of a packer to expand.

In some implementations, use of the tools may eliminate, or may reduce the number of, bottom hole assembly runs used for testing. For example, the tools may eliminate the need to make three independent bottom hole assembly runs sometimes needed to perform integrity testing, such as liner top testing, of the type described in this specification. Thus, rig time, cost, and personnel used for testing may be reduced.

In some implementations, the tools may be run in conjunction with other wellbore cleaning or testing tools. In some cases, the tools may also be used for applications other than integrity testing, such as well flow back testing, acidification, and cement squeeze operations.

All or part of the tools described in this specification and their various modifications can be implemented or controlled, at least in part, via a computer program product, such as a computer program tangibly embodied in one or more information carriers, such as in one or more tangible machine-readable storage media, for execution by, or to control the operation of, data processing apparatus, such as a programmable processor, a computer, or multiple computers A computer program can be written in any form of programming language, including compiled or interpreted languages, and it can be deployed in any form, including as a stand-alone program or as a module, part, subroutine, or other unit suitable for use in a computing environment. A computer program can be deployed to be executed on one computer or on multiple computers at one site or distributed across multiple sites and interconnected by a network.

Actions associated with operating or controlling the tools can be performed or controlled by one or more programmable processors executing one or more computer programs to perform the functions of the calibration process. All or part of the tools can be controlled using special purpose logic circuitry, for example an FPGA (field programmable gate array) and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer (including a server) include one or more processors for executing instructions and one or more storage area devices for storing instructions and data. Generally, a computer will also include, or be operatively coupled to receive data from, or transfer data to, or both, one or more machine-readable storage media, such as mass storage devices for storing data, for example magnetic, magneto-optical disks, or optical disks. Non-transitory machine-readable storage media suitable for embodying computer program instructions and data include all forms of non-volatile storage area, including by way of example, semiconductor storage area devices such as EPROM, EEPROM, and flash storage area devices; magnetic disks such as internal hard disks or removable disks; magneto-optical disks; and CD-ROM and DVD-ROM disks.

Each computing device, such as server, may include a hard drive for storing data and computer programs, and a processing device (for example, a microprocessor) and memory (for example, RAM) for executing computer programs.

Elements of different implementations described in this specification may be combined to form other implementations not specifically set forth above. Elements may be left out of the tools and associated components described in this specification without adversely affecting their operation or the operation of the system in general. Furthermore, various separate elements may be combined into one or more individual elements to perform the functions described in this specification.

Other implementations not specifically described in this specification are also within the scope of the following claims.

What is claimed is:

1. A tool for testing a wellbore, comprising:

a body having a longitudinal dimension configured for insertion into a casing of the wellbore;

multiple packers disposed along the body, each packer comprising multiple, redundant activation mechanisms, each of the activation mechanisms being configured to cause a packer to expand against an inner diameter of the casing to enable testing the wellbore, each of the activation mechanisms being configured to cause a packer to retract independently of the other packers, at least one activation mechanism of each packer comprising:

a rotary activation mechanism that applies weight to each packer;

a radio frequency identification (RFID) device configured to identify a radio frequency signal and, in response to the radio frequency signal, to cause each packer to expand or retract; and at least one switch that is configured for hydraulic operation to cause each packer to expand or retract, the at least one switch comprising one or more preset pressure activation switches;

where rotation of each packer in a first direction causes diametric expansion of each packer, and where rotation of each packer in a second direction causes diametric retraction of each packer, the second direction being opposite the first direction.

2. The tool of claim 1, further comprising a scraper assembly disposed along the body for arrangement downhole of the multiple packers when the body is inserted into the casing, where the diametric expansion causes the packer to expand against the inner diameter of the casing, where the scraper assembly is spring-loaded, and where the scraper assembly is located downhole of the multiple packers when the tool is within the wellbore.

3. The tool of claim 2, where at least part of each of the packers is configured to rotate to cause the packer to expand against the inner diameter of the casing, and where the scraper assembly comprises a composite block to scrape and to clean to at least a packer setting depth.

4. The tool of claim 1, where at least part of each packer is configured to rotate to cause the packer to expand against the inner diameter of the casing, and where at least two packers of the multiple packers are operated in synchronism.

5. The tool of claim 1, where each of the multiple packers is separated by a part of the body; and where each of the packers is configured to expand against the inner diameter of the casing independently of the others of the packers.

6. The tool of claim 1, where each packer is configured to provide bi-directional sealing of an uphole part of the casing from a downhole part of the casing.

7. The tool of claim 1, further comprising:

a hydraulic anchor slip mechanism configured to provide resistance to uphole movement of the packer, where the hydraulic anchor slip mechanism comprises a wedge-shaped device having wickers on its face for penetrating and griping the inner diameter of the casing when the packer is expanded to reach the inner diameter of the casing.

8. The tool of claim 1, where each packer comprises:
one or more drag blocks; and
multiple J-slot sleeves to support several cycles of activation and de-activation,
where each packer is controllable to enable circulation within the wellbore uphole of the packer.

9. The tool of claim 1, where the casing comprises a casing string comprised of casing segments, the casing segments being connected by a joint, at least two of the casing segments comprising different diameters;
where the tool is controllable to isolate the joint uphole of each packer from a portion of the wellbore that is downhole of the packer,
where a first packer of the multiple packers expands to a first diameter equal to the smallest inner diameter of the casing segments, and
where a second packer of the multiple packers expands to a second diameter equal to the largest inner diameter of the casing segments.

10. The tool of claim 1, comprising a scraper assembly disposed along the body for arrangement downhole of the multiple packers when the body is inserted into the casing.

11. A system comprising:
a casing string comprising a first casing segment comprising a first inner diameter and a second casing segment comprising a second inner diameter, the first casing segment and the second casing segment being separated by a first joint, the casing string further comprising:
a third casing segment separated from the second casing segment by a second joint; and
a tool configured to fit within the casing string, the tool comprising:
a first packer to isolate, for integrity testing, a first part of the casing string not containing the first joint from a second part of the casing string containing the first joint, the first packer comprising multiple activation mechanisms to cause the first packer to expand to isolate the first part from the second part; and
a second packer to isolate, for integrity testing, the second part of the casing string not containing the second joint from a third part of the casing string containing the second joint, the second packer comprising multiple activation mechanisms to cause the second packer to expand to isolate the second part from the third part,
where the first packer expands to the first inner diameter,
where the second packer expands to the second inner diameter, and
where the first inner diameter is larger than the second inner diameter.

12. The system of claim 11, where the multiple activation mechanisms comprise a radio frequency identification (RFID) device configured to identify a radio frequency signal and, in response to the radio frequency signal, to cause at least one of the first packer and the second packer to expand against an inner diameter of the casing string.

13. The system of claim 12, where the multiple activation mechanisms comprise a rotation mechanism that is configured to rotate to cause at least one of the first packer and the second packer to expand against an inner diameter of the casing string.

14. The system of claim 11, where the multiple activation mechanisms comprise at least one switch that is configured for hydraulic operation to cause at least one of the first packer and the second packer to expand against an inner diameter of the casing string,
where the system is configured for a positive pressure test, and
where the positive pressure test is done at a predetermined mud weight equivalent to a calculated pressure of not more than 80% of at least one of a casing burst pressure and a liner burst pressure.

15. The system of claim 11, where the multiple activation mechanisms comprise:
a radio frequency identification (RFID) device configured to identify a radio frequency signal and, in response to the radio frequency signal, to cause at least one of the first packer and the second packer to expand against an inner diameter of the casing string;
at least one switch that is configured for hydraulic operation to operate the packer to cause at least one of the first packer and the second packer to expand against the inner diameter of the casing string; and
a rotation mechanism that is configured to rotate to cause at least one of the first packer and the second packer to expand against the inner diameter of the casing string.

16. The system of claim 15, further comprising:
a fourth casing segment separated from the third casing segment by a third joint; and
a third packer comprising multiple activation mechanisms.

17. The system of claim 11, where the integrity testing is negative integrity testing,
where the first joint connects the first casing segment to the second casing segment and provides a seal therebetween, and
where the first packer is configured to expand to the largest internal-diameter casing segment subjected to the integrity testing.

18. The system of claim 11, where the integrity testing is positive integrity testing, and
where the first joint is susceptible to at least one of damage and leakage.

19. The system of claim 11, where each of the first packer and the second packer comprises a rotary activation mechanism that applies weight to the packer, the rotary activation mechanism being one of the multiple redundant activation mechanisms.

20. The system of claim 19, where rotation of the packer in a first direction causes diametric expansion of the packer, and
where rotation of the packer in a second direction causes diametric retraction of the packer, the second direction being opposite the first direction.

21. The system of claim 11, wherein integrity testing of the first casing segment is performed without requiring a separate operation to clean out cement from the casing string.

22. A tool for testing a wellbore, comprising:
a body having a longitudinal dimension configured for insertion into a casing of the wellbore; and
multiple packers disposed along the body, each packer comprising multiple, redundant activation mechanisms, each of the activation mechanisms being configured to cause a packer to expand against an inner diameter of the casing to enable testing the wellbore, each of the activation mechanisms being configured to cause a packer to retract independently of the other packers, at least one activation mechanism of each packer comprising:
a rotary activation mechanism that applies weight to each packer;

a radio frequency identification (RFID) device configured to identify a radio frequency signal and, in response to the radio frequency signal, to cause each packer to expand or retract; and at least one switch that is configured for hydraulic operation to cause each packer to expand or retract, the at least one switch comprises one or more preset pressure activation switches;

where each RFID comprises a unique radio frequency signature, where each of the at least one switches is operatively coupled to a wellhead on the surface via a separate hydraulic fluid line, and where rotation of each packer may be controlled independently of the rotation of any other packer.

* * * * *